US010400793B2

(12) United States Patent
Chang et al.

(10) Patent No.: US 10,400,793 B2
(45) Date of Patent: Sep. 3, 2019

(54) BALANCE STRUCTURE OF FAN

(71) Applicant: ASIA VITAL COMPONENTS CO., LTD., New Taipei (TW)

(72) Inventors: Bor-Haw Chang, New Taipei (TW); Chung-Shu Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 15/885,682

(22) Filed: Jan. 31, 2018

(65) Prior Publication Data

US 2019/0234427 A1 Aug. 1, 2019

(51) Int. Cl.
*F04D 29/66* (2006.01)
*F04D 29/32* (2006.01)

(52) U.S. Cl.
CPC ..... *F04D 29/662* (2013.01); *F04D 29/329* (2013.01)

(58) Field of Classification Search
CPC combination set(s) only.
See application file for complete search history.

(56) References Cited

U.S. PATENT DOCUMENTS 3,315,750 A * 4/1967 Delaney ..... F04D 29/34 416/144
5,829,318 A * 11/1998 Hannah ..... D06F 37/225 74/570.2
6,356,409 B1 * 3/2002 Price ..... F16F 15/32 360/98.07
6,358,009 B1 * 3/2002 Link ..... F04D 29/662 416/145
2005/0047003 A1 * 3/2005 Nakamiya ..... G11B 19/2009 360/99.08
2008/0002361 A1 * 1/2008 Fagrenius ..... H02K 7/061 361/695
2008/0063526 A1 * 3/2008 He ..... F04D 25/0613 416/144
2014/0338193 A1 * 11/2014 Wilson ..... F04D 29/662 29/889.21

* cited by examiner

*Primary Examiner* — Nathaniel E Wiehe
*Assistant Examiner* — David Whittaker
(74) *Attorney, Agent, or Firm* — Jackson IPG PLLC; Demian K. Jackson

(57) ABSTRACT

The present invention relates to a balance structure of a fan, which comprises a hub and a balance slider. The hub has a circumferential portion and a top portion. The circumferential portion has a plurality of blades. The top portion is provided with a groove having a latch portion. The balance slider has a receiving portion slidingly engaging with the latch portion such that the balance slider can be slidingly disposed in the groove and the balance slider can move to a balance position automatically during the rotation of the hub. In this way, the effect of automatic balance can be achieved.

6 Claims, 4 Drawing Sheets

(a) (b) (c)

BALANCE STRUCTURE OF FAN

BACKGROUND OF THE INVENTION

Field of the Invention

The present invention relates to a balance structure of a fan and, in particular, to a balance structure of a fan which achieves the effect of automatic balancing through a rotational centrifugal force.

Description of Prior Art

A fan is an active heat-dissipating device, mainly used for forced heat dissipation. A fan is generally disposed at a place where heat is generated to provide forced heat dissipation or is disposed in a space for guiding circulating air. With development of computer technology, operating frequencies and performance of components inside the computers increase and thus power consumption and heat generation of components inside the computers increase accordingly. In order to reduce the temperature inside a PC case and dissipate the heat generated, a heat-dissipating mechanism with a high performance is required to help remove the heat generated from the components inside the PC case to keep the interior of the PC case from remaining in a high temperature state which further affects the lifetime of internal components or causes unstable operation. In the field of heat dissipation for computer systems, a mainstream computer cooling technique commonly used in industry is a combined heat-dissipating system including a fan and heat-dissipating fins. The fan, which is an axial fan, a centrifugal fan, or a mixed flow fan, is always equipped with heat-dissipating fins as a main choice to resolve the issue of system over-temperature and help remove the heat generated from the internal components.

The principle of wind generation of the fan is based on the shape design of the blades on the rotor and the motor and a circuit board to make the rotor rotate at a rated speed such that air flows through the blades to generate airflow. Meanwhile, the rotating component (i.e., the rotor) achieves a smooth rotation by a balancing mechanism to prevent undesired vibration that induces noise and affects the fan structure to decrease the lifetime of the fan.

As for a traditional fan, the smaller the fan size is, the more important the vibration requirements of the fan become. When the fan is compact and lightweight, the vibration requirements of the fan are demanding. Thus, the balancing process to meet the required vibration specifications is challenging. It is usually difficult to control an adequate amount of balancing weight and then the balancing process needs to be repeated to converge to meet the requirements. Therefore, the balancing process takes much more time to obtain a better balancing quality or the work force and balancing equipment increase to maintain a substantial capacity. As a result, the production cost increases and the whole cost-effectiveness is lost.

The balancing methods currently used in the fan industry include manual weight addition/removal balancing methods and automatic addition/removal balancing methods using automatic equipment, but the corresponding cost of the balancing equipment also impairs the whole cost-effectiveness.

Therefore, how to decrease the balancing process time and reduce the costs of the work force and equipment to maintain high fan quality and capacity is always an ultimate goal of the fan industry.

SUMMARY OF THE INVENTION

Thus, to effectively overcome the above problems of the prior art, the primary objective of the present invention is to provide a balance structure of a fan in which a balance slider can move to a balance position automatically during rotation of a hub such that an effect of automatic balance can be achieved.

To achieve the above objective, the present invention provides a balance structure of a fan which comprises a hub and a balance slider.

The hub has a circumferential portion and a top portion. The circumferential portion has a plurality of blades. The top portion is provided with a groove having a latch portion. The balance slider has a receiving portion slidingly engaging with the latch portion.

Due to torque equilibrium, the balance slider of the present invention, disposed in the groove, moves automatically to the required balance position during rotation of the hub to achieve a natural balance. In this way, the time of repeatedly searching the balance position and the amount of balancing ballast are saved. That is, the work hours and the production cost can be reduced.

DETAILED DESCRIPTION OF THE INVENTION

The above objective, structural and functional characteristics of the present invention will be described according to the preferred embodiments with the accompanying figures.

Figure 1:
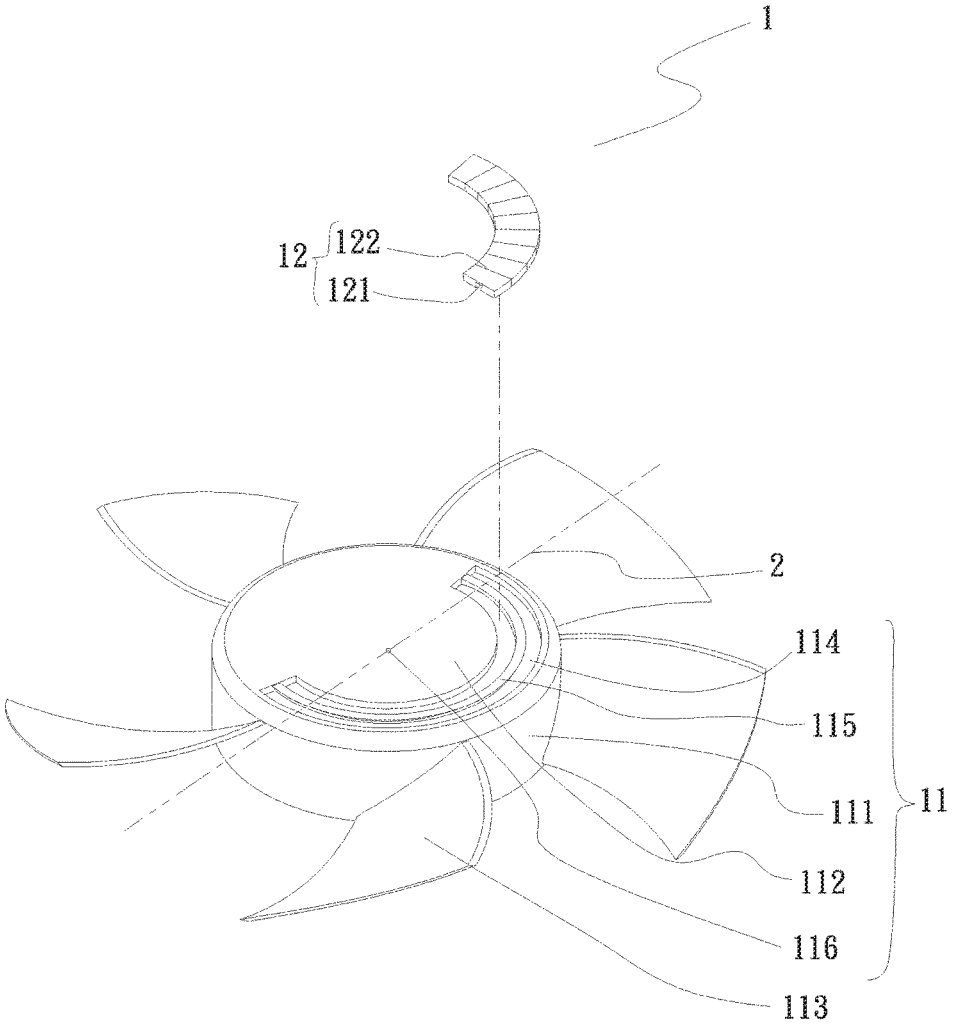
FIG. 1 is a perspective exploded view of a balance structure of a fan according to a first embodiment.
Figure 2:
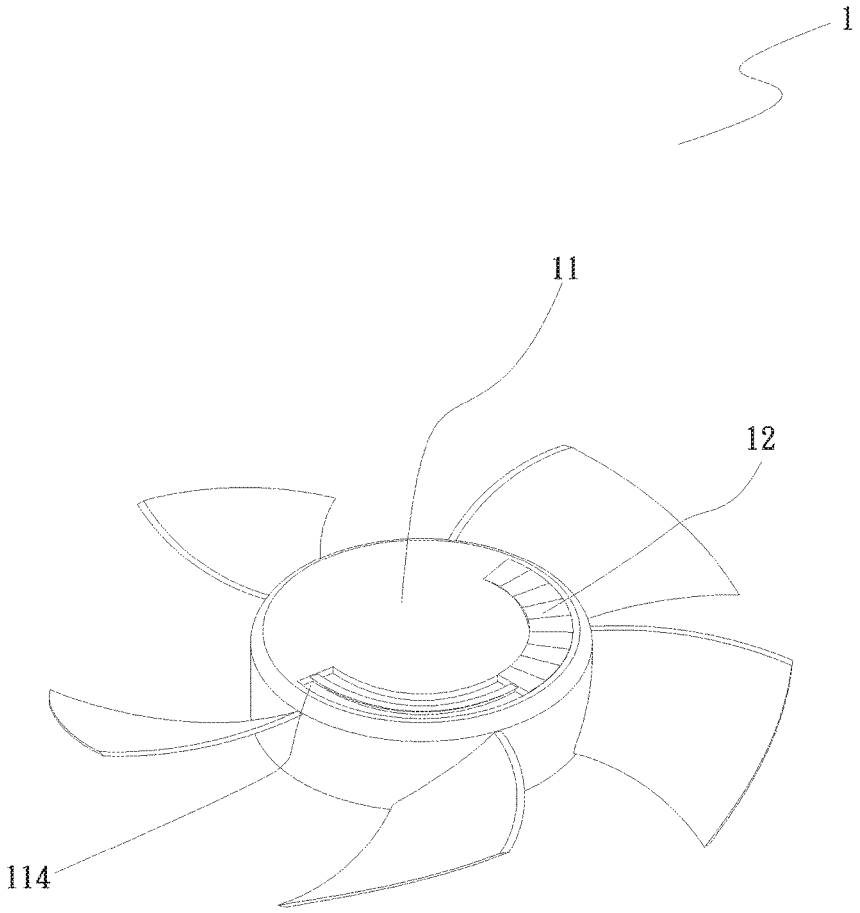
FIG. 2 is a perspective-assembled view of the balance structure of a fan according to the first embodiment.

Please refer to FIGS. 1 and 2, which are a perspective exploded view and a perspective-assembled view of a balance structure of a fan according to a first embodiment of the present invention, respectively. As shown in FIGS. 1 and 2, the balance structure of a fan 1 of the present invention comprises a hub 11 and a balance slider 12.

The hub 11 has a circumferential portion 111 and a top portion 112. The circumferential portion 111 has a plurality of blades 113. The top portion 112 is provided with a groove 114. The groove 114 has a latch portion 115. The groove 114 is recessed on the top portion 112 of the hub 11. The groove 114 has an arc shape of more than 180°. The top portion 112 of the hub 11 has a virtual centerline segment 2 passing through the center 116 of the hub 11. Two ends of the virtual centerline segment 2 extend outward from the center 116 of the hub 11 such that the virtual centerline segment 2 is longer than the diameter of the hub 11. The groove 114 has an arc shape with two ends extending and crossing the virtual centerline segment 2.

The balance slider 12 has a receiving portion 121 slidingly engaging with the latch portion 115 of the groove 114 such that the balance slider 12 is confined to be slidingly disposed in the groove 114. The balance slider 12 is provided with a plurality of scales 122 on the side opposite to the receiving portion 121. The scales 122 allow easy balance slider 12 disassembly. The balance slider 12 can be made of plastic, rubber, or metal.

The balance slider 12 has an arc shape of less than 180°. That is, the range of the arc shape of the balance slider 12 is less than that of the groove 114 disposed on the top portion 112 of the hub 11.

Figure 3:
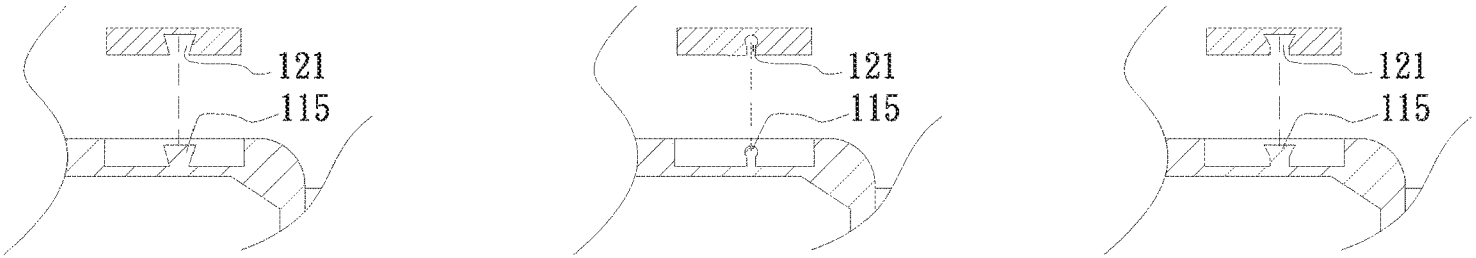
FIG. 3 is a cross-sectional schematic view of the balance structure of a fan according to the first embodiment.

Please refer to FIG. 3, which is a cross-sectional schematic view of the balance structure of the fan according to the first embodiment of the present invention. As shown in FIG. 3, the receiving portion 121 has a shape of a dovetail groove (FIG. 3(*a*)), the letter "Ω" (FIG. 3(*b*)), or a reversed-trapezoid groove (FIG. 3(*c*)). The latch portion 115 has a shape of a dovetail, the reversed letter "Ω", or a reversed-trapezoid such that the receiving portion 121 and the latch portion 115 are mutually complementary structures. However, the shapes of the receiving portion 121 and the latch portion 115 are not limited to those mentioned above. The receiving portion 121 and the latch portion 115 are a recessed structure and a protruding structure, respectively. The latch portion 115 is an arced track extending radially on the top portion 112 of the hub 11. The receiving portion 121 is an arced groove that is disposed corresponding to the latch portion 115.

The present invention is mainly an improvement based on the original fan structure. When the hub 11 is fabricated using injection molding, parameters about the injection mold are adjusted to control the process capability with a minimal unbalanced amount in the injection mold. Also, a recessed groove of more than 180 degrees (the groove 114) and an arced slider of less than 180 degrees (the balance slider 12) are formed on the surface of the hub 11 by removing the hub material. In addition, an internal sliding rail structure (the receiving portion 121 and the latch portion 115) is disposed on the surface of the surface of the hub 11 in which the auxiliary slider structure (the balance slider 12) is heavier than a weight of the hub material removed and can slide freely on the above-mentioned sliding rail (the receiving portion 121 and the latch portion 115). After the auxiliary slider structure (the balance slider 12) is installed on the latch portion 115 in the groove 114 of the top portion 112 of the hub 11, when the hub 11 starts to rotate, a balancing process is initiated. A vector summation of unbalance amounts of the blades of the hub 11 and/or the hub 11 itself cause weight reduced by the recessed groove (the groove 114) and a vector caused by the total weight for the final balance compensation together form a resultant vector having a direction pointing to the recessed groove (the groove 114). Because torque equilibrium has to be achieved after the rotation, when the blade balancing process begins, the corresponding auxiliary slider structure (the balance slider 12) is properly tailored through the surface scales (the scales 122) according to the weight for balance compensation and is then installed and rotated. The auxiliary slider structure (the balance slider 12) will move to a balance position automatically and stop such that torque equilibrium is achieved to meet the required vibration specifications.

Figure 4:
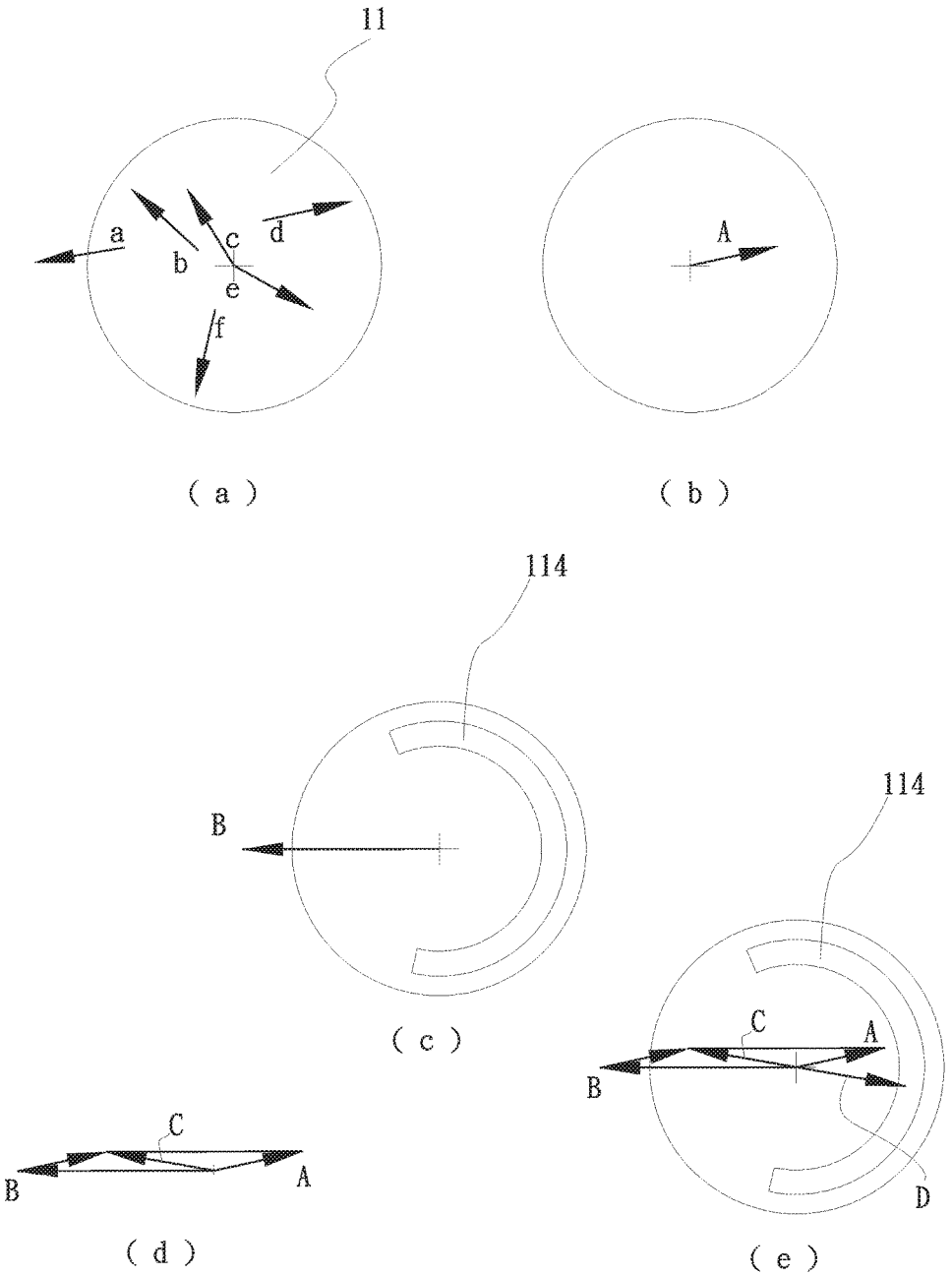
FIG. 4 is an implementation schematic view of the balance structure of a fan according to a second embodiment.

The present invention mainly uses the vector principle to determine that all the vector summation caused by the unbalanced amounts of the hub 11 has a smaller amount. Please refer to FIG. 4, which is an implementation schematic view of the present invention. FIGS. 4(*a*) and 4(*b*) are the top views of the hub 11. The distribution of the various unbalanced amounts of the hub 11 during the rotation of the hub 11 is shown in FIG. 4(*a*). The resultant vector by summing the various unbalance amounts in FIG. 4(*a*) is denoted by A, as shown in FIG. 4(*b*).

Referring to FIG. 4(*c*), the vector summation of the unbalance amounts caused by removing the recessed groove has a larger amount. The resultant vector after the recessed grooved is formed is denoted by B.

Referring to FIG. 4(*d*), the vector summation of vector A and vector B produces the resultant vector C.

Referring to FIG. 4(*e*), the position for the balance compensation is the direction of vector D and is located near the recessed groove; the weight for the balance compensation is the magnitude of vector D. Finally, the auxiliary slider structure (the balance slider) will stay in balance in the recessed groove.

What is claimed is:

1. A balance structure of a fan comprising:

a hub having a circumferential portion with a plurality of blades, a top portion provided with a groove recessed on the top portion of the hub and having a semi-circular arc shape of between 180° and 360°, and a latch portion and a balance slider having a receiving portion slidingly engaging with the latch portion such that the balance slider is slidingly disposed in the groove.

2. The balance structure of a fan according to claim 1, wherein the receiving portion and the latch portion are a recessed structure and a protruding structure, respectively, or are mutually complementary structures, wherein the latch portion is an arced track and the receiving portion is an arced groove which is disposed corresponding to the latch portion.

3. The balance structure of a fan according to claim 1, wherein the balance slider has an arc shape of less than 180°.

4. The balance structure of a fan according to claim 1, wherein the balance slider is provided with a plurality of scales on a side opposite to the receiving portion.

5. The balance structure of a fan according to claim 1, wherein a thickness of the balance slider is greater than, equal to, or less than the depth of the groove.

6. The balance structure of a fan according to claim 1, wherein the balance slider is made of plastic, rubber, or metal.

* * * * *